US011132985B2

(12) United States Patent
Howe et al.

(10) Patent No.: US 11,132,985 B2
(45) Date of Patent: Sep. 28, 2021

(54) VIBRAPHONE PICKUP

(71) Applicants: Gary Joseph Howe, Cedar City, UT (US); Peter Howe, Enoch, UT (US)

(72) Inventors: Gary Joseph Howe, Cedar City, UT (US); Peter Howe, Enoch, UT (US)

( * ) Notice: Subject to any disclaimer, the term of this patent is extended or adjusted under 35 U.S.C. 154(b) by 0 days.

(21) Appl. No.: 17/237,854

(22) Filed: Apr. 22, 2021

(65) Prior Publication Data

US 2021/0241741 A1 Aug. 5, 2021

Related U.S. Application Data

(63) Continuation of application No. 16/859,097, filed on Apr. 27, 2020.

(60) Provisional application No. 62/838,820, filed on Apr. 25, 2019.

(51) Int. Cl.

| | |
|---|---|
| ***G10H 3/20*** | (2006.01) |
| ***G10D 13/09*** | (2020.01) |
| ***G10D 13/10*** | (2020.01) |

(52) U.S. Cl.

CPC ..... *G10H 3/20* (2013.01); *G10D 13/09* (2020.02); *G10D 13/10* (2020.02)

(58) Field of Classification Search

CPC ..... G10H 3/20; G10D 13/09; G10D 13/10
USPC ..... 84/725
See application file for complete search history.

(56) References Cited

U.S. PATENT DOCUMENTS

| | | | | | |
|---|---|---|---|---|---|
| 3,542,936 | A * | 11/1970 | Babicky | G10H 3/20 | 84/723 |
| 3,588,311 | A * | 6/1971 | Zoller | G10H 3/181 | 84/725 |
| 3,649,737 | A * | 3/1972 | Jespersen | G10H 3/20 | 84/725 |
| 3,657,461 | A * | 4/1972 | Freeman | G10H 3/181 | 84/726 |
| 4,184,398 | A * | 1/1980 | Siegelman | G10H 3/20 | 335/302 |
| 4,442,749 | A * | 4/1984 | DiMarzio | G10H 3/181 | 84/728 |
| 4,524,667 | A * | 6/1985 | Duncan | G10H 3/181 | 84/728 |
| 5,168,117 | A * | 12/1992 | Anderson | G10H 3/181 | 29/609.1 |
| 5,811,710 | A * | 9/1998 | Blucher | G10H 3/181 | 84/728 |
| 5,908,998 | A * | 6/1999 | Blucher | G10H 3/181 | 84/728 |
| 6,291,759 | B1 * | 9/2001 | Turner | G10H 3/181 | 336/110 |
| 7,189,916 | B2 * | 3/2007 | Kinman | G10H 3/181 | 84/726 |
| 7,227,076 | B2 * | 6/2007 | Stich | G10H 3/181 | 84/726 |

(Continued)

*Primary Examiner* — Christina M Schreiber
(74) *Attorney, Agent, or Firm* — Gurr Brande & Spendlove, PLLC; Robert A. Gurr

(57) ABSTRACT

A vibraphone pickup has a bobbin having two coils, one for outputting an analog signal and one for outputting a digital signal. A plurality of filters and buffers are used to isolate the signals. A rare earth (or neodymium) magnet is used in the center of the bobbin. In one method of use, a vibraphone pickup is used to pick up each note of the vibraphone. The output of each vibraphone pickup is combined and fed into an amplifier.

7 Claims, 5 Drawing Sheets

(56) References Cited

U.S. PATENT DOCUMENTS

| | | | | |
|---|---|---|---|---|
| 8,309,836 | B1 * | 11/2012 | Bolger | G10H 3/143 84/723 |
| 8,791,351 | B2 * | 7/2014 | Kinman | G10H 3/181 84/723 |
| 8,853,517 | B1 * | 10/2014 | Dixon | G10H 3/181 84/726 |
| 9,679,550 | B2 * | 6/2017 | Fishman | G10H 3/14 |
| 10,446,130 | B1 * | 10/2019 | Shaw | G10H 3/143 |
| 10,692,479 | B2 * | 6/2020 | Abe | G10H 3/143 |
| 2004/0124837 | A1 * | 7/2004 | Prammer | G01N 24/081 324/303 |
| 2004/0144241 | A1 * | 7/2004 | Juskiewicz | G10H 1/0058 84/723 |
| 2005/0162247 | A1 * | 7/2005 | Beller | G10H 3/181 335/179 |
| 2007/0079693 | A1 * | 4/2007 | Valli | G10C 3/06 84/723 |
| 2012/0118129 | A1 * | 5/2012 | Jang | G10H 3/181 84/726 |
| 2012/0163651 | A1 * | 6/2012 | Zhang | H04R 9/063 381/407 |
| 2014/0044293 | A1 * | 2/2014 | Ganem | B60L 53/122 381/323 |
| 2014/0245877 | A1 * | 9/2014 | Gelvin | G10H 3/181 84/727 |
| 2015/0199949 | A1 * | 7/2015 | Fishman | G10H 3/14 84/726 |
| 2016/0284331 | A1 * | 9/2016 | Fishman | G10H 3/14 |
| 2018/0017679 | A1 * | 1/2018 | Valouch | H01L 31/0224 |
| 2018/0102121 | A1 * | 4/2018 | Shaw | G10H 3/182 |
| 2020/0342840 | A1 * | 10/2020 | Howe | G10D 13/09 |
| 2021/0241741 | * | 8/2021 | Howe | G10D 13/09 |

* cited by examiner

VIBRAPHONE PICKUP

CROSS-REFERENCE TO RELATED APPLICATIONS

This application is a continuation of U.S. patent application Ser. No. 16/859,097, filed on Apr. 27, 2020, which claims the benefit of U.S. Provisional Application Ser. No. 62/838,820, filed on Apr. 25, 2019, both of which are incorporated herein by reference.

TECHNICAL FIELD

The present disclosure relates to methods of amplifying vibraphones. More particularly, the present disclosure relates to a pickup for each note of a vibraphone.

BACKGROUND

The vibraphone is a musical instrument comprising tuned metal bars and is usually played using soft mallets to strike the bars. It is often desirable to increase the sound resonating from the vibraphone. There are currently two options for amplifying the sound: 1) contact pickups (typically a piezo element); and 2) microphones. Contact pickups are physically attached to the bars, which dampens the bars and hinders the bars from producing the correct tone. This is also difficult to do because it requires the user to put a pickup on each bar and in the right position on the bar. Further, if the contact pickup is placed in the wrong position, it can dampen the bar completely. On the other hand, microphones do not pick up all the sounds of the bars evenly, causing a distorted feedback. Microphones may also pick up more than just the vibraphone, leading to extra, undesired noise.

Prior attempts to solve these problems have been unsuccessful. For example, U.S. Pat. No. 3,649,737 to Jespersen (the '737 patent) discloses the use of a magnetic pickup coil positioned under each bar and coupled to an amplifier and sonic transducer to reproduce music notes. However, the configuration of the coil and its positioning in relation to the bars, among other things, resulted in weak amplification, which caused it to not be widely adopted. The '737 patent also lacked the ability to amplify both analog and digital outputs. Therefore, there is a need to improve the '737 patent's attempt and solve the issues that remained.

Accordingly, there is a need for a system and method of amplifying the sound of a vibraphone (or similar instrument) that does not dampen the bars and that reduces extra noise and feedback. The present disclosure solves these and other problems.

SUMMARY OF EXAMPLE EMBODIMENTS

In one embodiment, a vibraphone pickup comprises a bobbin with at least one magnet, such as a rare earth (or neodymium) magnet, in the center thereof and copper wire (e.g., 42 AWG copper wire) wrapped (e.g., 8,000-10,000 times) around a first channel and a second channel.

In one embodiment, a first end of the vibraphone pickup is used to pick up analog sound and a second, opposite end is used to generate digital sound, outputted as musical instrumental digital interface ("MIDI"). The output can be fed into an amplification and signal detection circuit, which detects the note, start, stop, and volume information.

In one embodiment, a vibraphone pickup comprises a plurality of filters and buffers.

In one method of use, a vibraphone pickup is used to pick up each note of the vibraphone. The output of each vibraphone pickup is combined and fed into an amplifier.

In one method of use, the vibraphone pickup is used with a variety of instruments. For example, the vibraphone may be used with the glockenspiel, marimba, bells, chimes, cymbals, drums, etc. In one method of use, a vibraphone pickup may be coupled to a piano, allowing output of the piano to MIDI and/or analog.

In one method of use, for instruments having wooden bars, a recess is created in each wooden bar and is filled with a magnet or magnetic material, such as magnetic epoxy, which allows it to interact with the vibraphone pickup disclosed herein.

DETAILED DESCRIPTION OF EXAMPLE EMBODIMENTS

Figure 1:
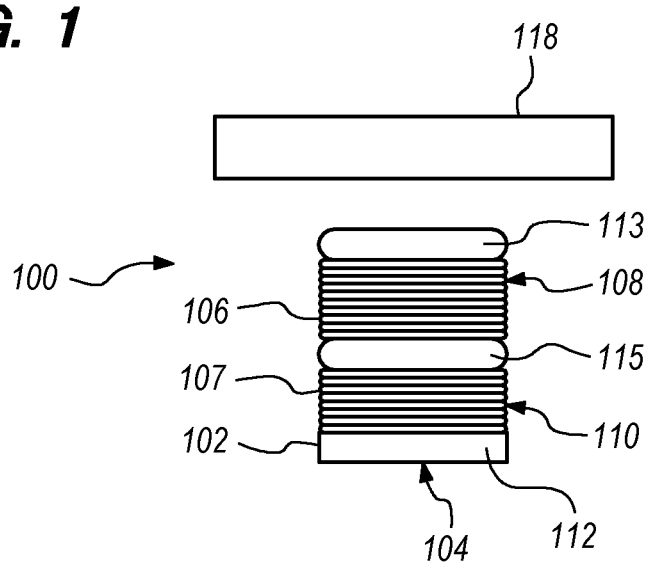
FIG. 1 illustrates a vibraphone pickup.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a system and a method of amplifying the sound of a vibraphone that does not dampen the bars and that reduces extra noise and feedback. The vibraphone pickup described below solves these, and other, problems.

Amplifying percussion instruments can be difficult. One method used in the art is to use one or more piezos and secure them (e.g., using adhesives, straps, etc.) to the instrument. However, this can dampen the sound produced by the instrument. In other words, the vibraphone relies on vibration to create sound, so securing components to a vibraphone bar reduces the vibrations and may also alter the tone. Further, with repeated use, the adhesive or strap may begin to fail, which creates unwanted sounds and results. Accordingly, it is difficult to amplify the correct tones from a vibraphone with the current systems in the art. The vibraphone pickup disclosed herein is able to amplify the correct tone, without dampening the sound produced. To amplify a digital sound, an analog-to-digital converter (ADC) and MIDI processor are used. The processor(s) determine the pitch and the voltage of the signal, which will then determine the amplitude.

Figure 2:
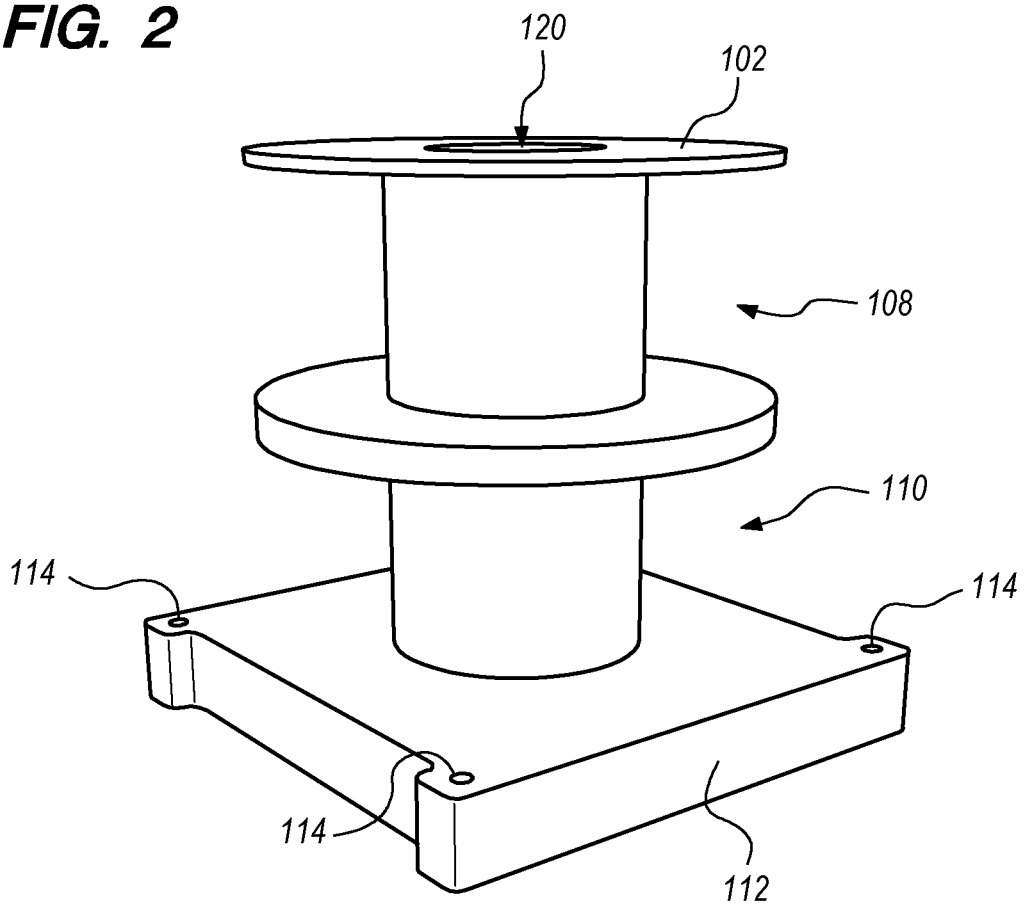
FIG. 2 illustrates a bobbin of a vibraphone pickup.
Figure 3:
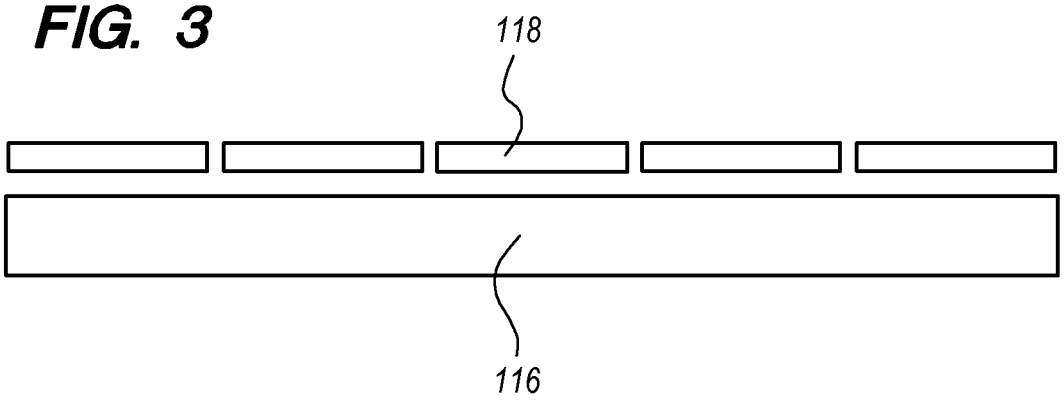
FIG. 3 illustrates a housing containing a plurality of vibraphone pickups positioned beneath a plurality of vibraphone bars.

In one embodiment, as shown in FIGS. 1-3, a vibraphone pickup 100 comprises a bobbin 102 with at least one magnet 104, such as a rare earth, neodymium, or other magnet, ideally passing through the center of the bobbin from top to bottom, and a first copper wire 106 (e.g., 42 AWG copper wire) wrapped (e.g., 8,000-10,000 times) around a first channel 108 and a second copper wire 107 wrapped around a second channel 110. The bobbin 102 may further comprise a base 112 with securement apertures 114 for coupling the bobbin 102 to a housing 116 (shown in FIG. 3). The housing 116 may be coupled to the vibraphone using the vibraphone frame so as to not interfere with, or dampen, vibraphone bars 118 as they are played. In other words, the housing 116 does not come into contact with the vibraphone bars. The bobbin 102 may comprise a magnet aperture 120 for receiving at least one magnet 104. Because each instrument has a variety of ranges of permeability, the size and shape of the bobbin may be adjusted to receive the range of permeability for a given instrument. Accordingly, it will be appreciated that the bobbin 102 may come in a variety of sizes and shapes so that it may be used with numerous instruments, such as a piano or marimba, among others. While a first and second channel 108, 110 are illustrated, only one channel is required. Therefore, in other embodiments, the bobbin may have only one channel wrapped with wire. In another embodiment, the bobbin may have a plurality of channels, which may include more than two channels.

The at least one magnet 104 may be a rare earth magnet. For example, the rare earth magnet may be neodymium-iron-boron or samarium cobalt. With the use of the at least one magnet 104 inserted into the magnet aperture 120, the magnetic field is stronger, and more signals can be obtained from the copper wire 106, 107 coiled around the bobbin 102. When the at least one magnet 104 is a strong magnet, such as the rare earth magnet described above, a clear and loud signal is produced. On the other hand, if a weaker magnet is used, such as those typically used in the prior art, the signal to noise ratio is low, making it difficult to amplify the desired sound. In other embodiments, the at least one magnet 104 itself may comprise a bobbin formfactor, thereby combining the bobbin and magnet in one.

While 8,000-10,000 wraps of wire 106, 107 is discussed as an example, it will be appreciated that the bobbin 102 may be wrapped any number of times, such as 2,000, 4,000, 6,000, etc. Although 42 AWG copper wire may be used, the vibraphone pickup 100 is not limited to a particular gauge of wire or material. For example, the gauge of wire may be 40 AWG, 35 AWG, or any other suitable gauge of wire. Similarly, the wire material may vary. For example, the wire material may be other conductive material, such as silver. It will be appreciated that the bobbin 102 comprises a relatively thin top 113, which allows the copper wire 106 to be closer to the vibraphone bar 118 to receive a stronger, clearer signal. The first channel 108 is separated from the second channel 110 via a separator 115. The separator 115 is ideally non-conductive, such as plastic or rubber, so that the first wire 106 doesn't interfere with the second wire 107. This allows the first coil (i.e., the first channel 108 wrapped with first wire 106) to pickup sounds separable from the second coil (i.e., the second channel 110 wrapped with second wire 107).

Figure 4:
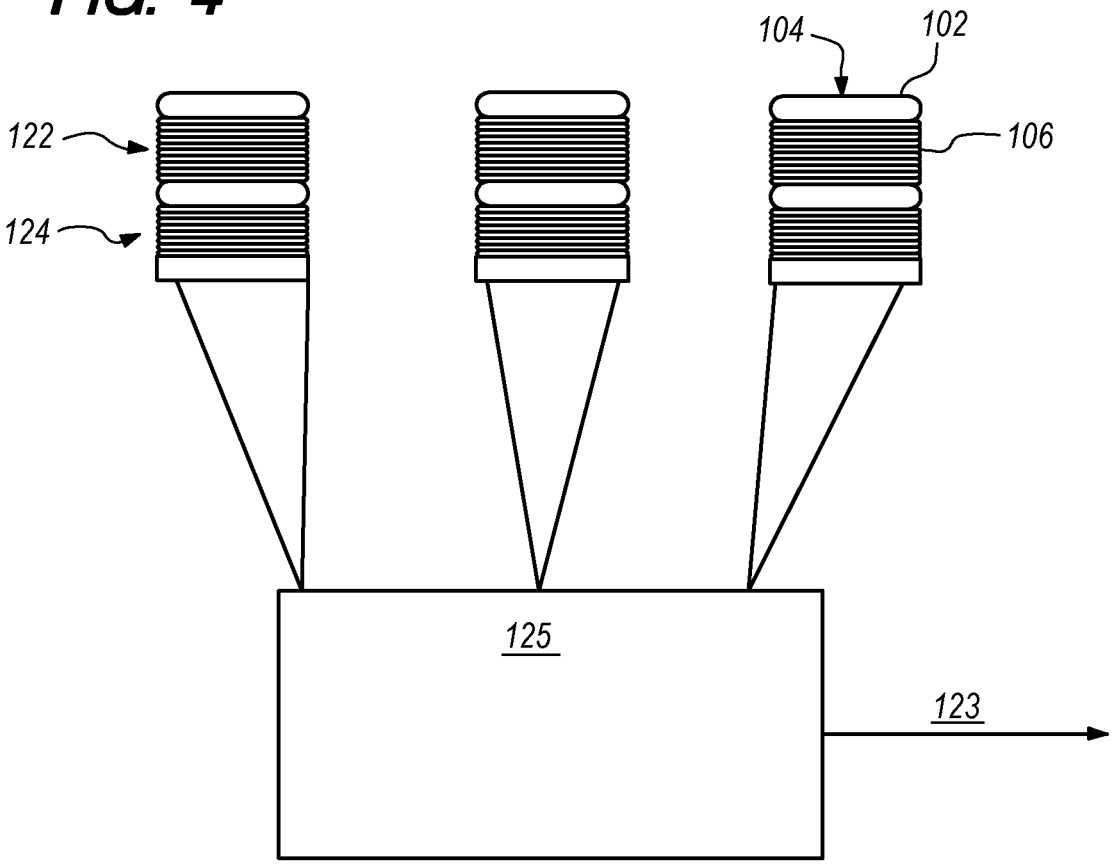
FIG. 4 illustrates a plurality of vibraphone pickups coupled to an ADC and MIDI processor.

Accordingly, as shown in FIG. 4, in one embodiment, the first coil 122 is used to pick up analog sound and the second, opposite coil 124 is used to generate digital sound as MIDI out 123, which is possible by converting the received sound to digital using an ADC and MIDI processor 125. The processors 125 determine the pitch and the voltage of the signal, which will then determine the amplitude. It will be appreciated that the first coil 122, used for analog sound, places the copper wire 106 in the first channel 108 closer to the vibraphone bars 118 where the copper wire 106 receives a stronger signal to get a higher volume of sound. Further, the output on the second coil 124 can be fed into an amplification and signal detection circuit, which detects the note, start, stop, and volume information.

Figure 5:
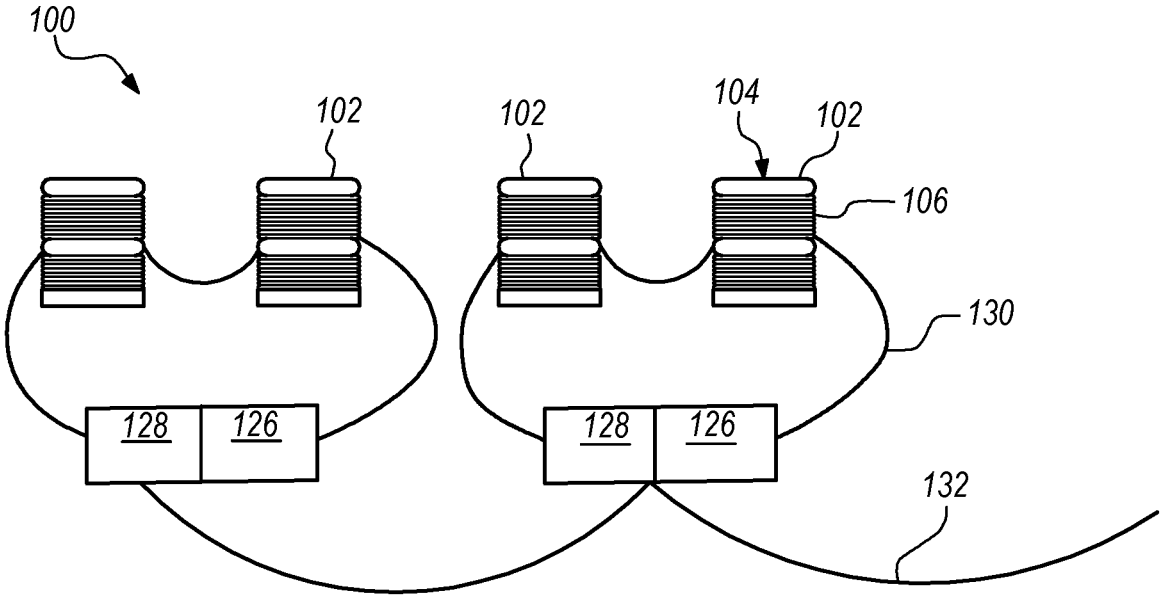
FIG. 5 illustrates a plurality of vibraphone pickups coupled to a plurality of filters and buffers.

Referring to FIG. 5, in one embodiment, a vibraphone pickup 100 further comprises a buffer 126 and a filter 128 coupled to each pair of bobbins 102 via first signal cords 130. The filter 128 is used to remove any unwanted sounds. In the prior art, when microphones are used to amplify the sounds of the vibraphone, there are often unwanted noises that disrupt the tone of the vibraphone. Having the filter 128 coupled to the vibraphone pickup 100 allows the sound of the vibraphone to be heard, without being overwhelmed by other unwanted sounds. The buffer 126 further assists in creating a clear and strong signal, but does so differently than the filter 128. The buffer 126 isolates the bobbins 102 so that they do not interfere with each other. This overcomes issues in the '737 patent, which required winding coils in opposite directions in an attempt to reduce interference. Further, the '737 patent could not transmit both analog and digital signals simultaneously. In contrast, using the vibraphone pickups disclosed herein, as the vibraphone is played, the vibraphone pickup 100 gathers the signal, sending it to the filter 128 and buffer 126 through the first signal cord 130. After the filter 128 and buffer 126 receive the signal, it can then be transmitted through a second signal cord 132 to, for example, the ADC and MIDI processor 125. While both a filter 128 and buffer 126 are shown and described, both are not required. For example, in one embodiment, the vibraphone pickup comprises an active filter, which eliminates the need for a buffer. Therefore, only at least one filter is required.

Figure 6:
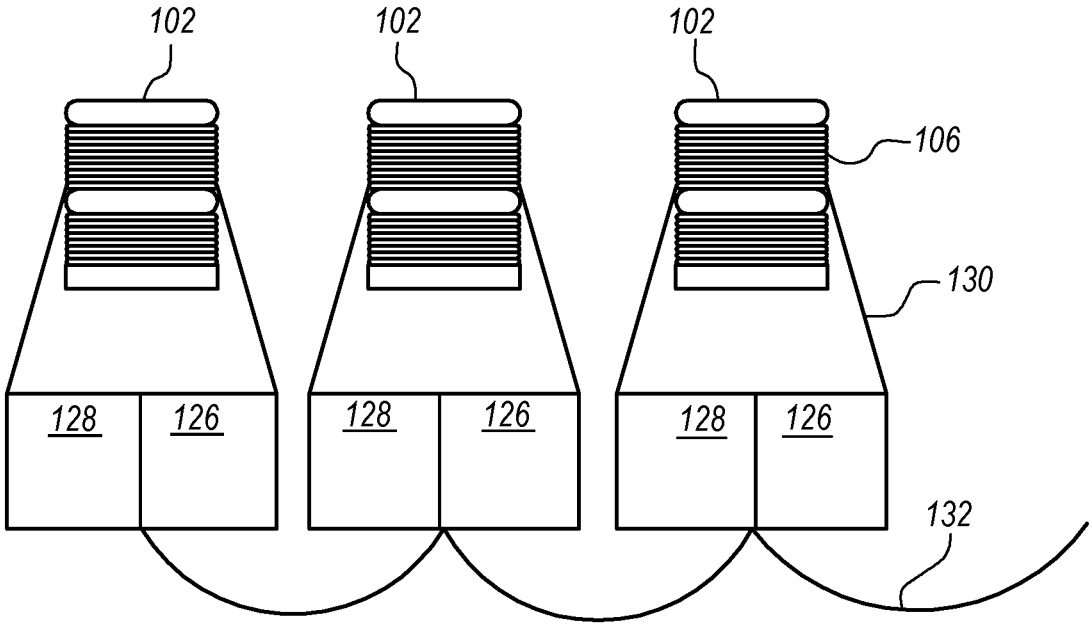
FIG. 6 illustrates individual vibraphone pickups coupled to a respective filter and a buffer.

In one embodiment, as illustrated in FIG. 6, a separate filter 128 and buffer 126 (buffer 126 not required) may be coupled to each bobbin 102. This further enhances the ability to isolate the sound generated by each bar above each bobbin 102. This allows each bobbin 102 to have one or more coils without interfering with one another, regardless of the direction of the coil. This is a significant improvement over the '737 patent, which required that each bobbin be wrapped distinctively so as to avoid interference. In a further improvement over the '737 patent, the vibraphone pickup disclosed herein may transmit both analog and digital signals simultaneously, something not achievable with the '737 patent.

Figure 7:
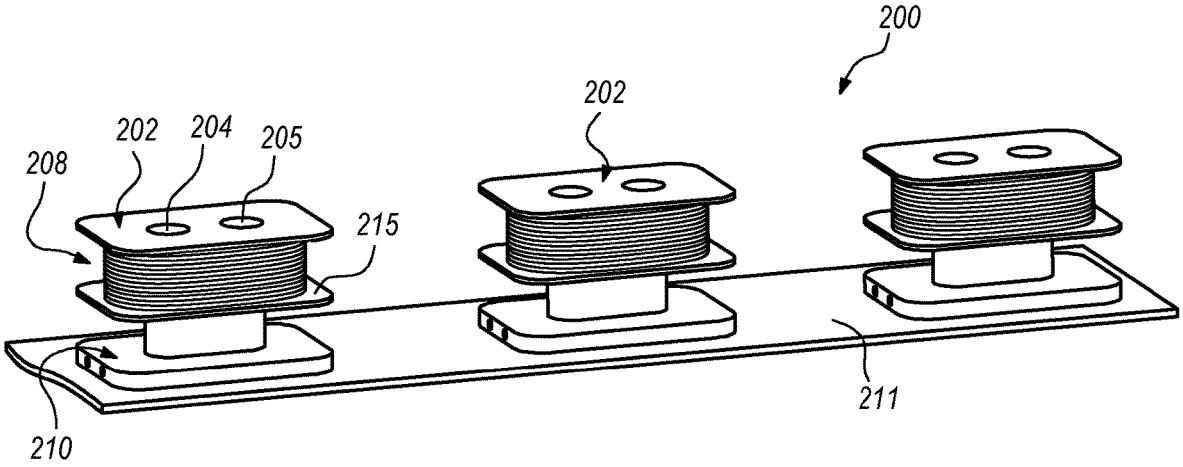
FIG. 7 illustrates a vibraphone pickup.
Figure 8:
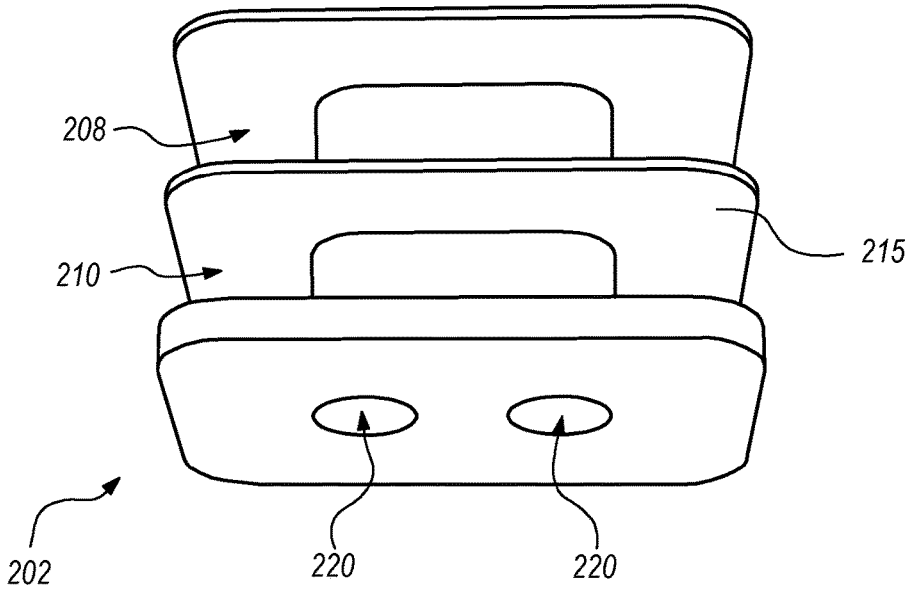
FIG. 8 illustrates a bobbin of a vibraphone pickup.

In one embodiment, as shown in FIGS. 7-8, a vibraphone pickup 200 comprises a bobbin 202 having a first magnet 204 and a second magnet 205 receivable with magnet apertures 220. Having more than one magnet increases the magnetic field and enhances the ability to pick up sound. However, while two magnets 204, 205 are shown, it will be appreciated that a single, larger magnet may achieve the same end result. Like previous embodiments, each bobbin 202 may comprise a first channel 208 and second channel 210 separated by a separator 215. As shown, each bobbin 202 is coupled to a circuit board 211 for relaying received signals. As shown, wire does not need to be wrapped on both channels 208, 210 of a bobbin 202. For example, if a user would like to produce analog sound alone, the bobbin 202 only needs to have wire wrapped on the first channel 208, forming a single coil. Likewise, if only digital sound is desired, only the second channel 210 needs to be wrapped with wire, forming a single coil. However, ideally, both channels 208, 210 are wrapped with wire (i.e., two coils), giving the ability of a user to use one or both signals simultaneously.

Figure 9:
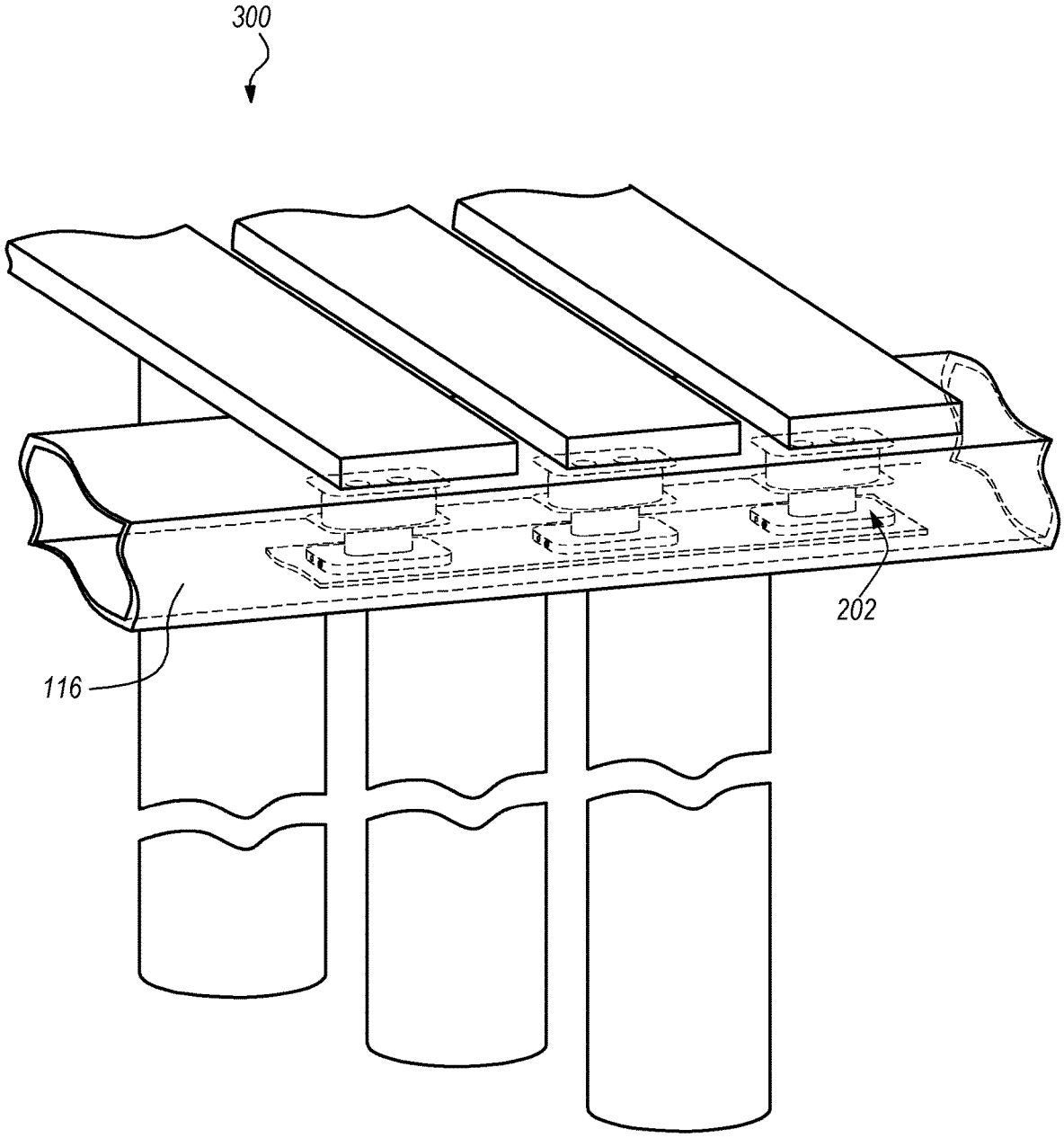
FIG. 9 illustrates a housing containing a plurality of vibraphone pickups coupled to a vibraphone.

FIG. 9 illustrates a vibraphone pickup housing 116 in use with a vibraphone 300. The vibraphone housing 116 may house either vibraphone pickup 100 or vibraphone pickup 200.

In one method of use, a vibraphone pickup 100, 200 is used to pick up each note of the vibraphone 300. For example, a bobbin 102, 202 is placed beneath each bar of a vibraphone 300. The housing 116 may contain the bobbins 102, 202 and other components, such as a circuit board 211. The output of each bobbin 102, 202 is filtered, combined, and fed into an amplifier. In one embodiment, the output of each bobbin 102, 202 is filtered 128 before being amplified. In another embodiment, one or more bobbins 102, 202 are coupled to a filter 128 before being amplified. By having a plurality of filters 128 coupled to the bobbins 102, 202, the ability to isolate the sound generated by each bar above each bobbin 102, 202 is enhanced. This is an improvement over the prior art, which does not disclose the use of a plurality of filters and is therefore inefficient at isolating and enhancing the output. Accordingly, in one embodiment, a vibraphone pickup comprises a plurality of bobbins, each having at least one channel and at least one magnet, the vibraphone pickup comprising a plurality of filters for isolating and enhancing the output from each vibraphone bar.

It will be appreciated that although referred to herein as a "vibraphone pickup," it is not limited to use with vibraphones. In one method of use, the vibraphone pickup is used with a variety of instruments. For example, the vibraphone may be used with the glockenspiel, marimba, bells, chimes, cymbals, drums, etc. In one method of use, a vibraphone pickup may be coupled to a piano, allowing output of the piano to MIDI or to analog. Depending on the instrument used, the orientation of the circuitry of the bobbins and filter and buffers will vary. For example, for certain instruments, two bobbins 102 (or bobbins 202) are connected to each other and then to a single filter and buffer (as shown in FIG. 5). In an alternate example, a single bobbin 102 (or 202) is connected to its own buffer and filter (as shown in FIG. 6).

In one embodiment, for an instrument having wood bars, plastic bars, or any other non-magnetic bar material, the bar may be amplified by cutting or otherwise forming a recess into the bars and filling the recess with a magnet or magnetic material, such as magnetic epoxy, thereby allowing the bars to be magnetized. It will be appreciated that other approaches to magnetizing the bars may include coupling a magnet to the bar via glue, tape, etc., although this may not be ideal as it may dampen the sound of the bar. The vibraphone pickup may then be used with the bar so that the sound may be amplified. Alternatively, a hall effect sensor could be used with the magnetic wood bar to create a MIDI signal.

Accordingly, the vibraphone pickup described herein solves the problems in the art by sufficiently picking-up the output from each bar while minimizing additional sound and feedback, while further allowing a user to simultaneously output analog and digital sounds.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A vibraphone pickup, comprising:

a housing coupled to the underside of a vibraphone, the housing comprising a plurality of bobbins therein, each bobbin positioned beneath a different bar of the vibraphone, the housing further comprising a circuit board in communication with each bobbin, each bobbin comprising:

a first channel and a second channel separated by a separator, a base with securement apertures, a magnet aperture for receiving a magnet, the magnet aperture and magnet therein running through a center of the bobbin from a top to the base of the bobbin, a first coil comprising a first copper wire wrapped around the first channel, and a second coil comprising a second copper wire wrapped around the second channel;

a plurality of audio buffers and filters on the circuit board and coupled to the plurality of bobbins, each bobbin coupled to a separate audio buffer and filter via the circuit board; and a MIDI processor for processing signals received from the plurality of audio buffers and filters;

wherein the first coil outputs an analog signal and the second coil generates a digital audio signal simultaneously.

2. The vibraphone pickup of claim 1, wherein the first copper wire and the second copper wire are 42 AWG.

3. The vibraphone pickup of claim 2, wherein each copper wire is wrapped around the bobbin 8,000-10,000 times.

4. The vibraphone pickup of claim 1, wherein the magnet is a rare earth magnet.

5. The vibraphone pickup of claim 4, wherein the rare earth magnet is neodymium-iron-boron.

6. The vibraphone pickup of claim 4, wherein the rare earth magnet is samarium-cobalt.

7. The vibraphone pickup of claim 1, wherein the digital signal is outputted as MIDI.

* * * * *